United States Patent [19]

Gore et al.

[11] 4,292,798

[45] Oct. 6, 1981

[54] STRAND BREAK-OUT DEVICE

[75] Inventors: Colin E. Gore, Ilkley; John P. Coulter, Shipley, both of England

[73] Assignee: Wool Development International Limited, London, England

[21] Appl. No.: 116,500

[22] Filed: Jan. 29, 1980

[30] Foreign Application Priority Data

| | | | |
|---|---|---|---|
| Feb. 6, 1979 | [GB] | United Kingdom | 04177/79 |
| Apr. 23, 1979 | [GB] | United Kingdom | 14066/79 |
| Aug. 1, 1979 | [GB] | United Kingdom | 26777/79 |

[51] Int. Cl.[3] ..... D01H 13/16

[52] U.S. Cl. ..... 57/86

[58] Field of Search ..... 57/264, 78, 80, 85, 57/86, 87

[56] References Cited

U.S. PATENT DOCUMENTS

| | | | |
|---|---|---|---|
| 2,494,490 | 1/1950 | Rinehart et al. | 57/86 |
| 3,759,026 | 9/1973 | Hope | 57/86 X |
| 4,110,963 | 9/1978 | Plate et al. | 57/86 |

FOREIGN PATENT DOCUMENTS

| | | | |
|---|---|---|---|
| 788906 | 1/1958 | United Kingdom | 57/86 |
| 817248 | 7/1959 | United Kingdom | 57/86 |

*Primary Examiner*—Donald Watkins

*Attorney, Agent, or Firm*—Norbert P. Holler

[57] ABSTRACT

A strand break-out device for preventing the formation of the fault yarns due to strand breakage when two unspun fibrous strands are spun on a common twisting spindle. A member (24) has pins (38) forming a passage means to which the strands converge during travel to the spindle and on which the strands may bear to apply force to the member. The member is pivotally mounted on a support (28) so that it may move freely on the support between limits of displacement from a mean, stable disposition. If a strand breaks the force applied by the remaining strand moves the member beyond the respective limit whereupon the member moves to a further position wherein the pins distort the path that the remaining strand would otherwise take. This distortion is such as to cause the remaining strand to break.

32 Claims, 7 Drawing Figures

STRAND BREAK-OUT DEVICE

This invention relates to a method and device for preventing the formation of fault yarns due to strand breakage when two unspun fibrous strands (e.g. slubbings or rovings) are spun on a common twisting spindle in the operation commonly referred to as "double-rove" spinning. In this operation, should one of the strands break, the remaining strand or strands will generally continue to be formed into yarn which has one ply less than the two plies desired, and which will thus be faulty. In subsequent processing, e.g. weaving, the faulty section may not have sufficient strength to withstand the stresses imposed and so may break. Even a fairly short section of faulty yarn can render a whole package of yarn useless, for that package cannot be sold with the fault. Thus it is advantageous to provide means whereby, if one strand breaks, the remaining strand is also broken. With all strands broken the formation of fault yarn, e.g. "spinners' singles" is prevented. Such means may be referred to as a "break-out" device.

Break-out devices for spinning frames have been proposed in which a cutting edge or abrasion surface acts to sever the remaining one of two strands in the event of one of the strands breaking. However, such devices have drawbacks in that they may not act positively enough, they can cause fly which may affect spinning and clog up the device and, in the case of knife edges, they may be dangerous to operatives, especially when piecing-up. Devices with knife edges or other strand gripping and cutting means may also have the disadvantage that when a strand is cut the free end may fly from the knife and foul adjacent strands so disrupting the spinning operation on adjacent spindles of the frame.

The invention seeks to provide a break-out device for a twisting spindle which is positively acting, which does not necessitate sharp edges or abrasive surfaces, and which mitigates other disadvantages associated with earlier break-out devices.

According to a first aspect of the present invention, a strand break-out device for prevention of faults due to strand breakage when combining two unspun fibrous strands into a yarn on a common twisting spindle comprises a member having passage means to which, in use, the strands converge from opposite sides of a centre line of the passage means so that both strands pass through the passage means and may bear thereon to apply force to the member, and a support on which the member is mounted, the support and the member being such that the member may move freely under forces applied by the strands in normal operation between limits of displacement from a mean, stable position relative to the support and may additionally move beyond either limit on breakage of a strand only by overcoming a resistance to such additional movement, each such additional movement being to a further position wherein the passage means introduces a distortion into the path that the remaining strand would normally take so causing that strand to break.

The arrangement of the member may be considered as providing a shallow potential energy well or trough at the top of a potential "hill". In such a situation a small force is necessary to overcome the resistance required to displace the member out of its potential well, but once on the slope of the potential hill the member will complete its displacement to the further position of its own accord. The potential energy involved can be gravitational potential, or it can be stored in other forms such as a spring or a magnetic field due to a permanent or electro-magnet. In other words, the resistance to be overcome before the member may move beyond either displacement limit, may be that of gravity or of other means such as a spring or magnetic field. It will be appreciated that for the purposes of this invention the member in its mean, stable position serves essentially as a detector of the preferred line of travel of the combined strands rather than providing any positive guiding action for the strands. Small deviations from that line due to minor changes in the relative strand tensions cause small movements from the mean position within the limits of displacement. However, if one strand breaks there is an immediate large imbalance in the forces on the member which is sufficient to overcome the resistance and move the member beyond its limit of displacement whereupon it moves to the respective further position. In this further position the distortion introduced by the passage means preferably serves to break the remaining strand either by preventing twist induced at the twisting spindle from travelling past the barrier presented by the passage means, or by exerting sufficient frictional drag on the remaining strand, or by a combination of the two effects.

Preferably the member is pivotally mounted on the support for pivotal movement in a given plane from the mean position through a first angle to a limit of displacement to either side of the mean position, and, on overcoming the resistance, past the respective limit of displacement and through a second angle (desirably substantially greater than the first angle) to the respective further position.

In one preferred embodiment, the potential energy is provided by gravitation, and the member is pivotally mounted for rotation in a plane generally parallel to the path of the strands, and usually substantially vertical. Part of the member rests on an upper surface of the support when in the mean, stable position and the member has a degree of freedom about its pivot which permits limited translational movement of the member in a direction perpendicular to the upper surface. To move from the surface the member must overcome the resistance caused by a hump, or potential barrier, on either side of its mean position. Such a pair of humps or barriers may be physically present in the contour of the support surface, but the effect can also be achieved by a flat surface (or a curved surface of proper curvature) since the member must rise against gravitational resistance in the course of displacement to either side in order to move off the flat surface. Once over either barrier the member falls under its own weight, for example through approximately 180°, to the respective further position wherein the passage means present a barrier to the continued normal passage of the remaining strand, which thus breaks. If the member is allowed to fall through a full 180° then the respective further positions resulting from movement past either limit displacement are identical; if the falling movement is limited short of a full 180° the respective further positions will be different.

Another embodiment employs a member pivotally mounted in a plane generally transverse to the path of the strands, and usually substantially horizontal, the member being biassed against an abutting surface affording in effect a potential hill with a shallow trough at its apex. Again, the member will resist small movements away from its mean, stable position in either direction, but a larger displacement due to breakage of one strand will cause it to swing round under the action of the bias to a position where the remaining strand will break-out. To provide the bias a spring can be used, or a magnet or electro-magnet may attract a piece of ferromagnetic material on the guide. More conveniently, the energy stored in a strand under tension held out of a straight line can be utilised. In the latter case the passage means on the member can advantageously replace the conventional lappet guide.

The purpose of situating the member in a shallow potential well about its mean, stable position is that there will always be natural random displacements of the strands during processing, and it is undesirable that these should trigger the break-out device. Also, when spinning is stopped for any reason the tension on the strands becomes zero, and the self-centring effect provided by the potential well ensures that the break-out device will remain in its mean, stable position and not fall into the further or break'out position - which would require an operative to reset each device before recommencing spinning. When it is considered that there may be 400 spindles on a single spinning frame, it will be seen that this is a substantial advantage.

From a further aspect, the invention resides in a strand break-out device for use in combining two unspun fibrous threads into a yarn on a common twisting spindle, the device comprising a support, a member pivotally mounted on the support for pivotal movement in a first plane, a first support surface on the support, a second support surface on the member, the surfaces being wholly engageable to hold the member in a mean, stable position on the support and being partially engageable between limit displacements of the member through first equal angles to either side of the mean, stable position, the member having a translational degree of freedom about its pivot which allows the support surfaces to move apart and wholly out of engagement when either limit displacement is exceeded to allow pivoting of the member through a second angle to a further position, and strand passage means on the member, the strand passage means having lateral sections disposed symmetrically to either side of a centre line passing through the pivot axis and the mid-points of the support surfaces when the member is in its mean, stable position.

The invention also encompasses spinning apparatus comprising a twisting spindle, means for simultaneously feeding two unspun fibrous strands to the twisting spindle and, in the path of the strands from the feeding means to the twisting spindle, a strand break-out device of any of the aforementioned forms.

Specific embodiments of strand break-out devices according to the invention will be described further, by way of example only, with reference to the accompanying drawings, in which.

Figure 1:
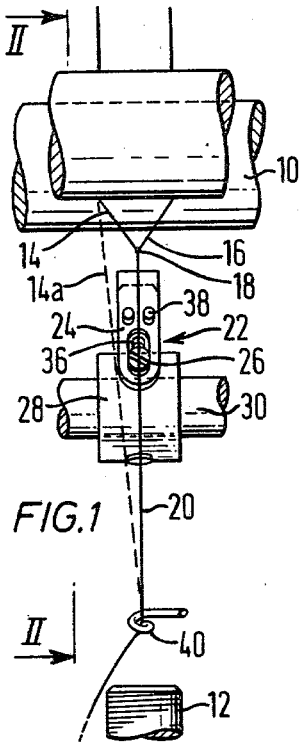
FIG. 1 is a front elevation of one embodiment of a break-out device according to the invention.
Figure 2:
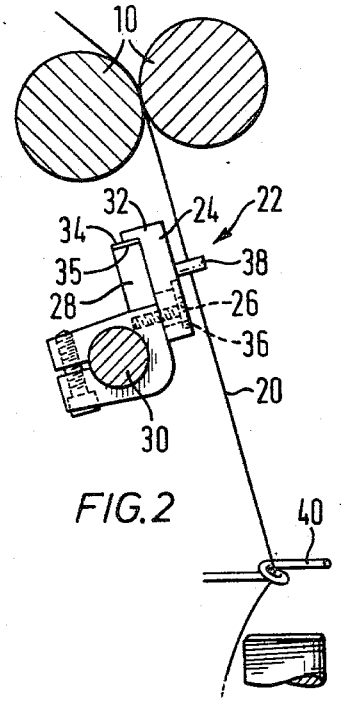
FIG. 2 is a section taken on the line II—II in FIG. 1.

FIG. 1 shows in diagrammatic form the front nip rollers 10 of a drafting system, e.g. a double apron drafting system, and a twisting spindle or bobbin 12 of a spinning frame. In the case illustrated, a double-rove yarn is being spun: that is two strands in the form of rovings 14, 16 are separately led through the drafting system and are spun onto a common spindle 12. The rovings 14, 16 meet at a point 18, called the convergence point, where they are plied into a yarn 20. In addition to the ply twist, amounts of the false twist applied to each separate roving are trapped within the individual strands in plied yarn.

The break-out device 22 comprises a main body member 24 mounted about a pivot pin 26 on a supporting block 28 which is in turn mounted on a convenient support rod or bar 30 fixed to the spinning frame. The body 24 has at its upper end a rearwardly extending flange 32 which rests on the top surface 34 of the block 28, the flange and the surface being wholly in engagement when the body is in the main, stable position shown in FIG. 1. The side edges 35 of the surface 34 are preferably chamfered. The pivot pin 26 is conveniently a screw or bolt which passes through an elongate slot 36 in the body 24 to allow free movement of the body about the pivot in a plane which is approximately vertical, being inclined at about 15° thereto, and substantially parallel to the plane of the path of the strands (whether individually or as yarn) past the body. The yarn 20 is led between two protruding rods or pins 38, forming a passage means on the body 24. The actual inclination of the plane may of course vary from that shown to suit the particular feed arrangement of a given spinning frame.

In operation, the two rovings 14, 16 are led from the front drafting rollers 10 to their natural convergence point 18 and then, as the combined yarn 20, through the passage means constituted by the pins 38 to a conventional lappet guide 40 and so to the twisting spindle or bobbin 12. Should, for example, the roving 16 accidentally break, the remaining roving 14 will take up a line **14*a* as shown by the broken line in FIG. 1. This sideways movement displaces the body 24 to the left sufficiently far to lift the body against gravitational resistance and to allow the flange 32 to slide off the surface 34 by way of the chamfered edge 35. The body 24 will then be unsupported and will pivot about the screw 26 under its own weight until it hangs upside down, i.e. it will pivot through about 180°. This causes the remaining strand 14 to be wrapped around the pins 38, which form a barrier preventing the false twist induced at the twisting spindle from travelling past the pins to the rollers 10**; the tension in this region of untwisted roving quickly causes the roving to break. A vacuum clearance system (not shown in the drawings) may continuously remove the broken-out rovings in the usual way.

It will be appreciated that, before the flange 32 can leave the surface 34, the body 24 must rise and thus overcome gravitational resistance to provide sufficient clearance and this is permitted by the slot 36. As the remaining roving pushes the body 24 to one side, the surface 34 raises it slightly until the flange 22 passes out of engagement with the surface 34 onto the chamfered edge 36 and the body falls under its own weight. The mean position of the body is thus a stable position of equilibrium at the bottom of a shallow potential well, and the body 24 tends to be self-centring between limits of displacement equally spaced to either side of the mean position for small deflections such as occur naturally during spinning. During such deflections the flange 22 remains in partial engagement with the surface 34. The relatively large deflection caused by one strand breaking is, however, sufficient to overcome the resistance of lifting the body to the position where it will tip over.

The purpose of the elongate slot 36 is two-fold. Firstly, as already mentioned, it allows the body 24 to rise sufficiently for the flange to clear the surface 34. In the normal operating position, however, as will be seen from FIG. 1, the pivot bolt 26 is close to the bottom of the slot. When a break occurs, and the body 24 is displaced so that the flange leaves the surface 34, the body drops until the pivot bolt 26 is at the top of the slot 36. This has the effect of shortening the radius of rotation and makes it easier for the body to rotate. A radius of rotation taking the guide rods 38 too far outside the new path 14*a* of the remaining strand would be resisted by the strand in proportion to the amount of such additional displacement, and if the radius of rotation were too great the body might be prevented from rotating through 180°, and break-out of the strand might not then occur.

In the event of a machine shutdown, the self-centring action returning the body to the mean position ensures that there is no tendency for the body to overbalance, and so time-consuming re-setting by an operative is not necessary.

Figure 3:
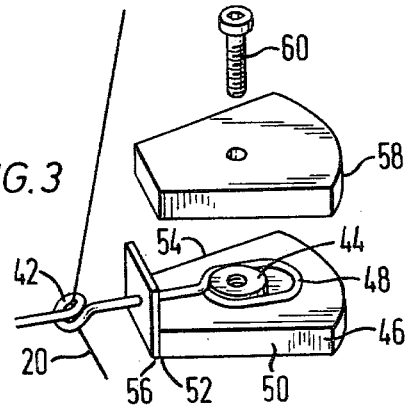
FIG. 3 is an 'exploded' perspective view of another embodiment.

In FIG. 3 an embodiment of the invention is shown which is intended to replace the conventional lappet guide, e.g. the guide 40 shown in FIG. 1. Instead of the pigtail lappet guide being fixed, as is usual, a pigtail 42 is mounted to be capable of pivoting about a boss 44 on a block 46. The remote end 48 of the pigtail is in the form of an elongated loop surrounding the boss 44. The block 46 has abutment surfaces 50, 52, 54 against one of which bears a plate 56 fixed to the shank of the pigtail 42. A block 58, preferably similarly shaped to the block 46, overlies the latter, and may be fixed thereto and to the machine frame by a bolt 60, the raised boss 44 ensuring the freedom of the pigtail to pivot about the boss between the blocks.

This device operates as follows. In ordinary use the yarn 20, which is under tension from the winding-on device, i.e. the twisting spindle 12, bears against the pigtail 42 and exerts a force towards the block assembly 46, 58, holding the plate 56 against the surface 52 and the corresponding surface of the block 58. With the plate wholly in contact with these surfaces the pigtail is in a mean, stable position. Small changes in strand tension may cause pivotal movement about the boss 44, with the plate remaining partially in contact with the surfaces between equal limits of displacement to either side of the mean position. Should either of the component strands break, the remaining strand will move to one or other side of its normal path, and the action of this on the pigtail is sufficient to move the plate beyond the respective limit of displacement and laterally off the surface 52. The energy stored in the yarn under tension, held by the pigtail out of a straight line, is released and the pigtail swings through a relatively large displacement, e.g. in the order of 90°, the plate 56 coming to rest against the surface 50 or 54 as the case may be. In this further position the pigtail exerts a frictional drag causing rapid break-out of the remaining strand.

As will be appreciated, in order for the plate 56 to clear the corners between the surfaces 50 and 52, or 52 and 54, the pigtail must move a small distance away from the block assembly, and the shape of the looped end 48 is designed to allow this. Thus this embodiment also is self-centring for small displacements from equilibrium. However, after break-out, the operator must piece-up, and the sideways forces inevitably applied to a lappet guide during this operation would tend to trigger displacement of the guide if modified in the manner described. Accordingly, it is desirable to incorporate a manually operated locking mechanism such that the operator may lock the guide in position for piecening-up and release it immediately thereafter.

Figure 4:
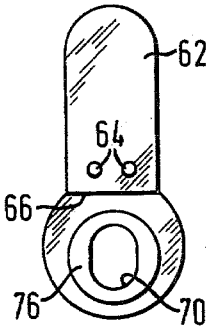
FIG. 4 is a front elevation of part of a further embodiment of the break-out device according to the invention.
Figure 5:
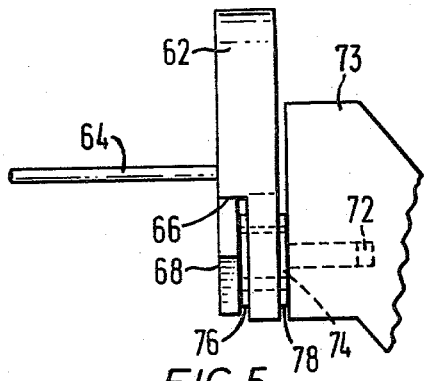
FIG. 5 is a side elevation of the break-out device shown in FIG. 4.

With reference to FIGS. 4 and 5 in this further embodiment according to the invention, a body member 62 has pins 64 forming passage means as previously described. The body member has a stepped front surface forming a flange 66 which rests in engagement with the top flat of an hexagonal head screw 68 when the body member is in its mean, stable position. The screw 68 which for the sake of simplicity is not shown in FIG. 4 forms a pivot for the body member, which has a slot 70 (an enlarged circular hole may, in some cases, suffice) allowing the pivotal movement and the required degree of translational movement perpendicular to the top flat of the screw. The hexagonal head screw 68 has a stepped shank so that when it is driven into a receiving hole 72 on a convenient support rod or bar 73 fixed to the spinning frame the shoulder 74 limits the travel to a predetermined extent. Raised bosses 76 and 78 hold the body member 62 clear of the screw head and support 73 so that the member will not foul these elements when it rotates on breakout.

Operation of this embodiment is similar to that described for the FIG. 1 embodiment. During normal operation the yarn formed from the strands passes between the pins 64 forming the passage means. Slight tension changes in the strands may cause rocking of the body member 62 on the top flat of the screw, with the flange 66 retaining partial engagement with that flat between equal displacement limits to either side of the mean position shown. If one strand breaks, the tension in the remaining strand pivots and lifts the body member to move beyond the respective displacement limit whereupon it falls through about 180° to a position wherein the pins present a barrier causing the remaining strand to break.

Figure 6:
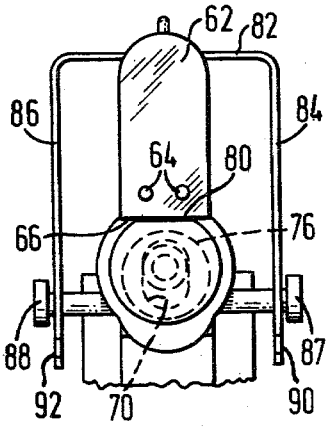
FIG. 6 is a front elevation of yet a further embodiment of the break-out device according to the invention.
Figure 7:
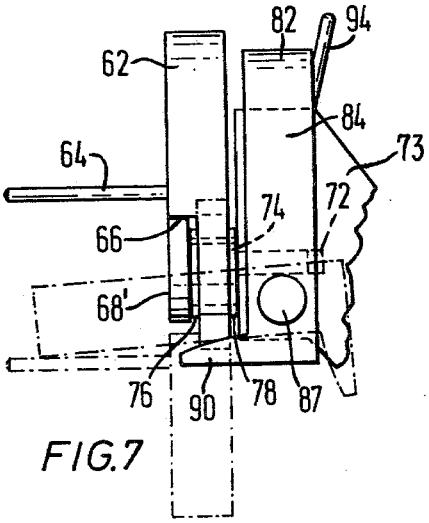
FIG. 7 is a side elevation of the break-out device shown in FIG. 6.

The embodiment shown in FIGS. 6 and 7 is similar to that of FIGS. 4 and 5 save that the shape of the body member 62 is somewhat different and the hexagonal head screw is replaced by a screw 68' having a circular head with a flat 80 forming a chord of the circle and constituting the support surface for the flange 66 of the body member 62. In addition, these Figures show the use of an optional guard which will prevent inadvertent piecing-up with the body member 62 lying in its downward position after breakout.

The guard comprises a U-shaped body having a bight 82 and arms 84, 86 pivoted on the support 73 about two aligned pins 87, 88. The guard has forwardly projecting nose portions 90, 92 at the ends of the arms 84, 86. In the normal operating position shown in full lines in FIG. 7 the guard is held between the body member 62 and a stop rod 94 fixed to the support 73. When a strand breaks and the body member 62 rotates about its pivot to fall under the action of gravity through about 180° the member will contact a respective one of the nose portions 90, 92. This causes the guard to move forwardly about its pivot axis so that it also falls under the action of gravity so that the bight 82 of the guard comes to rest on the pins 64 as shown in broken lines in FIG. 7. The presence of the guard prevents strands from being inserted between the pins 64 so that piecing-up can not be effected until the body member 62 is rotated back to its upper position, during which action it contacts an arm 84 or 86 of the guide to lift this back to its upper position also and clear the pins 64. The guard may be distinctively coloured so that it will provide a visual indication to an operator that the strands at that particular location have been broken-out.

Although the break-out device has been described in the context of combining two strands, it will be appreciated that it may be used where more than two strands are being combined, as long as the strands are led through the passage means at angles that in normal operation will maintain the body member within limits of displacement from a mean, stable disposition and that a breakage of one or more strands will leave an unstable situation that will cause the member to move beyond either limit to a position where the passage means presents a barrier that will cause breaking-out of any or all remaining strands.

We claim:

1. A strand break-out device for prevention of faults due to strand breakage when combining two unspun fibrous strands into a yarn on a common twisting spindle, the device comprising a member having passage means to which, in use, said strands converge from opposite sides of a centre line of said passage means so that both said strands pass through said passage means and may bear thereon to apply force to the said member, a support, means mounting said member on said support, said support and said member being such that said member may move freely under forces applied by said strands in normal operation between limits of displacement from a mean, stable position relative to said support and may additionally move beyond either said limit on breakage of one of said strands only by overcoming a resistance to such additional movement, each such additional movement being to a further position wherein said passage means introduces a distortion into the path that the remaining one of said strands would normally take so causing said remaining strand to break.

2. A strand break-out device according to claim 1 in which the distortion introduced by said passage means is such as to prevent twist induced at said twisting spindle from travelling past said passage means.

3. A strand break-out device according to claim 1 in which the distortion introduced by said passage means is such as to cause sufficient frictional drag to be exerted on said remaining strand to cause breakage of that strand.

4. A strand break-out device according to claim 1 in which said means mounting said member on said support is pivot means allowing said member pivotal movement in a given plane from said mean position through a first angle to either said limit of displacement to a respective side of said mean position, and, on overcoming the resistance, past the respective one of said limits and through a second angle to the respective one of said further positions.

5. A strand break-out device according to claim 4 in which said second angle is greater than said first angle.

6. A strand break-out device according to claim 4 in which said passage means has lateral sections on which said strands may bear to apply force to said member, said lateral sections, when said member is in said mean position, being disposed symmetrically to either side of a centre line passing through the axis of said pivot means.

7. A strand break-out device according to claim 6 in which said passage means comprises two parallel pins projecting from said member substantially perpendicular to said given plane, and said lateral sections are those surfaces of said pins which face towards the other of said pins.

8. A strand break-out device according to claim 7 and including a guard movable from a rest position to an operative position when said member moves to each respective one of said further positions, in which operative position said guard prevents strands from being inserted between said pins.

9. A strand break-out device according to claim 4 in which, in use, said given plane is substantially parallel with the plane of the paths of said strands through said passage means.

10. A strand break-out device according to claim 4 in which, in use, said given plane is inclined at such an angle to the horizontal that, after the resistance is overcome, said member moves under the force of gravity to the respective one of said further positions.

11. A strand break-out device according to claim 10 in which, in use, said member is supported in said mean position on an upper surface of said support.

12. A strand break-out device according to claim 11 in which said upper surface is generally flat and said member has a translational degree of freedom about said pivot means which permits limited movement of said member in a direction perpendicular to said upper surface.

13. A strand break-out device according to claim 12 in which the width of said upper surface is such that said member is supported on said upper surface when lying at any position between said limits of displacement.

14. A strand break-out device according to claim 13 in which at each end of said upper surface there is a chamfered section from which said member may fall to the respective one of said further positions when the resistance necessary to move said member as far as the respective one of said chamfered sections has been overcome.

15. A strand break-out device according to claim 14 in which at each end of said upper surface this joins an arcuate surface concentric with the axis of said pivot means, round which said member may fall to the respective one of said further positions when the resistance necessary to move said member off the respective end of said upper surface has been overcome.

16. A strand break-out device according to claim 4 in which, in use, said given plane is generally transverse to the path of said strands through said passage means.

17. A strand break-out device according to claim 16 in which said support has a first surface against which, in use, said member is held in its said mean position by the force applied by said combined strands, and said member has a translational degree of freedom about said pivot means which permits limited movement of said member in a direction perpendicular to said first surface, said member when moved past either limit of displacement moving beyond an end of said first surface and being drawn by the remaining one of said strands through said second angle into contact with a respective further surface of said support, said further surfaces each making a large angle with said first surface.

18. A strand break-out device according to claim 17 in which said surface and said further surfaces of said support are, in use, substantially vertical, and said given plane is substantially horizontal.

19. A strand break-out device according to claim 16 in which said passage means replaces the conventional lower guide of said spinning apparatus.

20. A strand break-out device for use in combining two unspun fibrous threads into a yarn on a common twisting spindle, the device comprising a support, a member, pivot means, pivotally mounting said member on said support for pivotal movement in a first plane, a first support surface on said support, a second support surface on said member, said support surfaces being wholly engageable to hold said member in a mean, stable position on said support and being partially engageable between limit displacements of said member through first equal angles to either side of said mean position, said member having a translational degree of freedom about said pivot means which allows said support surfaces to move apart and wholly out of engagement when either of said limit displacements is exceeded to allow pivoting of said member through a second angle to a further position, and strand passage means on said member, said strand passage means having lateral sections disposed symmetrically to either side of a centre line passing through the axis of said pivot means and the mid-points of said support surfaces when said member is in said mean position.

21. A strand break-out device according to claim 20 in which said strand passage means and said pivot axis are located to opposite sides of said support surfaces when said member is in said mean position.

22. A strand break-out device according to claim 20 in which said support surfaces are flat and lie in planes perpendicular to said first plane.

23. A strand break-out device according to claim 20 in which said support and pivot means are formed by a pivot pin having a shank projecting from a mounting block capable of being secured to spinning apparatus, said pivot pin having a head of which part of the periphery forms said first support surface, and said member comprises a body having a hole fitting around said pivot pin to allow the required pivotal and translational movement, said second support surface being formed on said body and spaced from the periphery of the hole.

24. A strand break-out device according to claim 23 in which said head of said pivot pin has a cross-section which is mostly circular, with said support surface forming a chord of that circle.

25. A strand break-out device according to claim 24 in which said chord subtends an angle of from 40° to 60° at the centre of said circle.

26. A strand break-out device according to claim 20 in which said passage means comprises two pins projecting from said body of said member.

27. A strand break-out device according to claim 22 in which a guard is pivoted on said mounting block about an axis of said pivot means and said member is dimensioned so that when between said limit displacements it prevents said guard from pivoting from a rest position but that when said member moves to either of said respective further positions said guard pivots to an operative position that prevents strands from being inserted into said passage means.

28. A strand break-out device according to claim 20 in which said support comprises a block having a first surface constituting said first support surface, said pivot means comprises a pivot pin projecting from said block with its axis parallel to the plane of said first surface, and said member comprises a body having at a first end a hole fitting around said pivot pin to allow the required pivotal and translational movement, at a second end said passage means and intermediate said first and second ends said second support surface.

29. Spinning apparatus comprising a twisting spindle, means for simultaneously feeding two unspun fibrous strands to the twisting spindle and, in the path of the strands from the feeding means to the twisting spindle a strand break-out device according to claim 1.

30. Spinning apparatus comprising a twisting spindle, means for simultaneously feeding two unspun fibrous strands to the twisting spindle and, in the path of the strands from the feeding means to the twisting spindle a strand break-out device according to claim 20.

31. In the method of spinning yarn in which two unspun fibrous strands are fed to a twisting spindle of a spinning apparatus, the steps comprising passing the strands through a drafting zone, converging the strands between the drafting zone and the twisting spindle, and passing the converged strands, prior to their arrival at the twisting spindle, through a strand break-out device as claimed in claim 1.

32. In the method of spinning yarn in which two unspun fibrous strands are fed to a twisting spindle of a spinning apparatus, the steps comprising passing the strands through a drafting zone, converging the strands between the drafting zone and the twisting spindle, and passing the converged strands, prior to their arrival at the twisting spindle, through a strand break-out device as claimed in claim 20.

* * * * *